US008000975B2

(12) United States Patent
Oh et al.

(10) Patent No.: US 8,000,975 B2
(45) Date of Patent: Aug. 16, 2011

(54) USER ADJUSTMENT OF SIGNAL PARAMETERS OF CODED TRANSIENT, SINUSOIDAL AND NOISE COMPONENTS OF PARAMETRICALLY-CODED AUDIO BEFORE DECODING

(75) Inventors: Jae-one Oh, Yongin-si (KR); Geon-hyoung Lee, Hwanseong-si (KR); Chul-woo Lee, Suwon-si (KR); Jong-hoon Jeong, Suwon-si (KR); Nam-suk Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 843 days.

(21) Appl. No.: 12/017,422

(22) Filed: Jan. 22, 2008

(65) Prior Publication Data

US 2008/0189117 A1 Aug. 7, 2008

(30) Foreign Application Priority Data

Feb. 7, 2007 (KR) ..... 10-2007-0012778

(51) Int. Cl.
*G10L 19/00* (2006.01)

(52) U.S. Cl. ..... 704/500

(58) Field of Classification Search ..... None
See application file for complete search history.

(56) References Cited

U.S. PATENT DOCUMENTS

| | | | | |
|---|---|---|---|---|
| 6,163,789 | A | 12/2000 | Liu | |
| 6,266,644 | B1 * | 7/2001 | Levine | 704/503 |
| 6,925,434 | B2 * | 8/2005 | Oomen et al. | 704/206 |
| 7,319,756 | B2 * | 1/2008 | Oomen et al. | 380/236 |
| 7,373,296 | B2 * | 5/2008 | Van De Par et al. | 704/226 |

(Continued)

FOREIGN PATENT DOCUMENTS

EP 1 387 487 A2 2/2004

(Continued)

OTHER PUBLICATIONS

Office Action issued by the Korean Patent Office dated Apr. 20, 2011 in a counterpart application No. 10-2007-0012778.

*Primary Examiner* — Talivaldis Ivars Smits
(74) *Attorney, Agent, or Firm* — Sughrue Mion, PLLC

(57) ABSTRACT

A method and apparatus for decoding a parametric-encoded audio signal are provided. According to the present invention, parameters extracted from a bitstream of a parametric encoded audio signal are adjusted by a user and component signals are synthesized based on the adjusted parameters to be displayed to a user so that a user can adjust the amplitudes of the component signals to apply various sound effects according to the user's desire. In addition, since an equalizer function is embodied in a codec of an audio reproduction apparatus, additional equalizer modules are not required and thus complexity of the audio reproduction apparatus can be reduced.

15 Claims, 5 Drawing Sheets

U.S. PATENT DOCUMENTS

| | | | | |
|---|---|---|---|---|
| 7,376,555 | B2 * | 5/2008 | Schuijers et al. | 704/211 |
| 7,499,852 | B2 * | 3/2009 | Oomen et al. | 704/206 |
| 7,516,066 | B2 * | 4/2009 | Schuijers et al. | 704/219 |
| 7,596,490 | B2 * | 9/2009 | Hotho et al. | 704/219 |
| 7,610,205 | B2 * | 10/2009 | Crockett | 704/503 |
| 7,640,156 | B2 * | 12/2009 | Gerrits et al. | 704/219 |
| 7,649,135 | B2 * | 1/2010 | Gerrits et al. | 84/600 |
| 7,664,633 | B2 * | 2/2010 | Den Brinker et al. | 704/206 |
| 7,725,310 | B2 * | 5/2010 | Den Brinker et al. | 704/219 |
| 7,734,473 | B2 * | 6/2010 | Schuijers et al. | 704/503 |
| 2005/0078832 | A1 * | 4/2005 | Van De Par et al. | 381/17 |
| 2007/0106505 | A1 * | 5/2007 | Gerrits et al. | 704/230 |
| 2008/0212784 | A1 * | 9/2008 | Szczerba et al. | 381/1 |
| 2008/0243493 | A1 * | 10/2008 | Rault et al. | 704/207 |
| 2008/0275696 | A1 * | 11/2008 | Kot | 704/211 |
| 2008/0312915 | A1 * | 12/2008 | Den Brinker et al. | 704/219 |

FOREIGN PATENT DOCUMENTS

| | | | |
|---|---|---|---|
| JP | 2000-081897 | A | 3/2000 |
| RU | 2 241 305 | C1 | 11/2004 |
| RU | 2 265 951 | C2 | 12/2005 |
| RU | 2 279 758 | C2 | 7/2006 |
| WO | 2004/054099 | A1 | 6/2004 |
| WO | 2005/073959 | A1 | 8/2005 |
| WO | 2007/007253 | A1 | 1/2007 |

* cited by examiner

USER ADJUSTMENT OF SIGNAL PARAMETERS OF CODED TRANSIENT, SINUSOIDAL AND NOISE COMPONENTS OF PARAMETRICALLY-CODED AUDIO BEFORE DECODING

CROSS-REFERENCE TO RELATED PATENT APPLICATION

This application claims priority from Korean Patent Application No. 10-2007-0012778, filed on Feb. 7, 2007, in the Korean Intellectual Property Office, the disclosure of which is incorporated herein in its entirety by reference.

BACKGROUND OF THE INVENTION

1. Field of the Invention

Apparatuses and methods consistent with the present invention relate to decoding an audio signal, and more particularly, to decoding parametric-encoded audio signals.

2. Description of the Related Art

Most related art high quality audio encoding apparatuses use a time-frequency transform method. According to this method, coefficients obtained by transforming an input audio signal into frequency domain by using transformation methods, such as a modified discrete cosine transform (MDCT), are encoded. In this case, however, when a target bit rate is lowered, the expressed sound quality is also reduced.

A parametric encoding method has been conventionally used for encoding an audio signal at a low bit rate. Examples of the parametric encoding method include a harmonic and individual lines plus noise (HINL) method and a sinusoidal coding (SSC) method. In parametric encoding methods, an original audio signal is modeled using component signals having predetermined characteristics, then, the component signals are detected from the audio signal, and parameters indicating the characteristics of the detected component signals are encoded. For example, if an audio signal is formed of a plurality of sinusoidal waves, the sinusoidal waves are detected from the audio signal, and only the frequency, phase, and amplitude of each of the detected sinusoidal waves are encoded, thereby achieving encoding an audio signal at a low bit rate.

FIG. 1 is a simplified block diagram of a related art parametric encoding apparatus. The parametric encoding apparatus illustrated in FIG. 1 operates on the assumption that an audio signal is formed of transient signals, sinusoidal signals, and noise. If a pulse code modulation (PCM) signal of the audio signal is input, a transient signal analyzer 110 analyzes transient signals included in the PCM signal, generates transient signal parameters, and a quantization unit 120 quantizes and encodes the transient signal parameters.

A transient signal synthesizer 130 synthesizes transient signals from the transient signal parameters, and a signal obtained by subtracting the synthesized transient signals from the original PCM signal is input to a sinusoidal analyzer 140.

The sinusoidal analyzer 140 analyzes sinusoidal signals included in the input signal, generates sinusoidal parameters, and a quantization unit 150 quantizes and encodes the sinusoidal parameters.

A sinusoidal synthesizer 160 synthesizes sinusoidal signals from the sinusoidal parameters. Thereafter, a signal obtained by subtracting the sinusoidal signals synthesized in the sinusoidal synthesizer 160 from the signal input to the sinusoidal synthesizer 160 is input to a noise analyzer 170. The noise analyzer 170 generates noise parameters from the input signal input thereto, and a quantization unit 180 quantizes and encodes the noise parameters.

A multiplexer 190 multiplexes the data of the encoded parameters and outputs the result as a bitstream.

FIG. 2 is a simplified block diagram of a related art audio reproduction apparatus including a parametric decoding apparatus and an equalizer. The parametric decoding apparatus illustrated in FIG. 2 is designed to decode the bitstream output from the encoding apparatus of FIG. 2. Here, an equalizer of a related art parametric decoding apparatus will be mainly described.

The input bitstream is divided into decoders with respect to component signals output by a demultiplexer 210. A transient signal decoder 220 decodes the bitstream and restores the transient signals. Similarly to the transient signal decoder 220, a sinusoidal decoder 230 restores the sinusoidal signals and a noise decoder 240 restores noise. Such signals are input together into a signal converter 250. The signal converter 250 converts input signals of time domain into frequency domain signals by using a fast Fourier transform (FFT) and MDCT. A frequency analyzer 260 analyzes the signals in the frequency domain and determines amplitudes of the component signals in each frequency band. A user input/output unit 270 receives a user input through a user interface 290, adjusts the amplitudes of the component signals in each frequency band according to the user input, and displays the amplitudes of the component signals in each frequency band to a user through the user interface 290. A signal converter 280 converts the frequency domain adjusted component signals of the user input/output unit 270 back into signals in time domain and outputs the signals through a speaker.

As described above, in the related art audio reproduction apparatus, the decoded signals are added together for a signal conversion and the amplitudes of the component signals in each frequency band are analyzed. Thus, finally restored signals may be different from the original signals. In addition, due to the equalizer modules 250 through 290, a configuration of the audio reproduction apparatus is complex. Consequently, a user adjusts the amplitudes for each signal component according to the parametric encoded model, and various sounds effects according to a user's desire cannot be applied.

SUMMARY OF THE INVENTION

The present invention provides an audio signal decoding apparatus which adjusts parameters of component signals of a parametric-encoded audio signal according to an input of a user and displays amplitudes of each component signal to a user, and a method thereof.

According to an aspect of the present invention, there is provided a decoding method including: extracting parameters from a parametric encoded audio signal with respect to component signals of the parametric encoded audio signal; adjusting the extracted parameters according to an input of a user; and synthesizing each of the component signals of the parametric encoded audio signal based on the adjusted parameters.

The method of decoding an audio signal may further include displaying amplitudes of the component signals of the parametric encoded audio signal which correspond to the adjusted parameters through a user interface.

The component signals may include at least one of a transient signal, a sinusoidal signal, and noise.

The parameters of the sinusoidal signals may include at least one of phase, amplitude, and frequency.

In the adjusting of the extracted parameters, in the adjusting of the extracted parameters, amplitudes of the sinusoidal signals of each frequency band included in the parametric encoded audio signal are adjusted independently.

In the displaying of the amplitudes, the amplitudes of the sinusoidal signals of each frequency band included in the parametric encoded audio signal are displayed.

The method of decoding an audio signal may further include comprising adding the synthesized component signals together to output the resultant signal through a speaker.

According to another aspect of the present invention, there is provided a computer readable recording medium having embodied thereon a computer program for executing the method of decoding an audio signal.

According to another aspect of the present invention, there is provided an audio signal decoding apparatus including: an extracting unit which extracts parameters from a parametric encoded audio signal with respect to component signals of the parametric encoded audio signal; an adjusting unit which selectively adjusts the extracted parameters according to an input of a user; and a synthesizing unit which synthesizes each of the component signals of the parametric encoded audio signal based on the selectively adjusted parameters.

BRIEF DESCRIPTION OF THE DRAWINGS

The above and other aspects of the present invention will become more apparent by describing in detail exemplary embodiments thereof with reference to the attached drawings in which.

DETAILED DESCRIPTION OF THE INVENTION

Hereinafter, the present invention will be described more fully with reference to the accompanying drawings, in which exemplary embodiments of the invention are shown.

Figure 1:
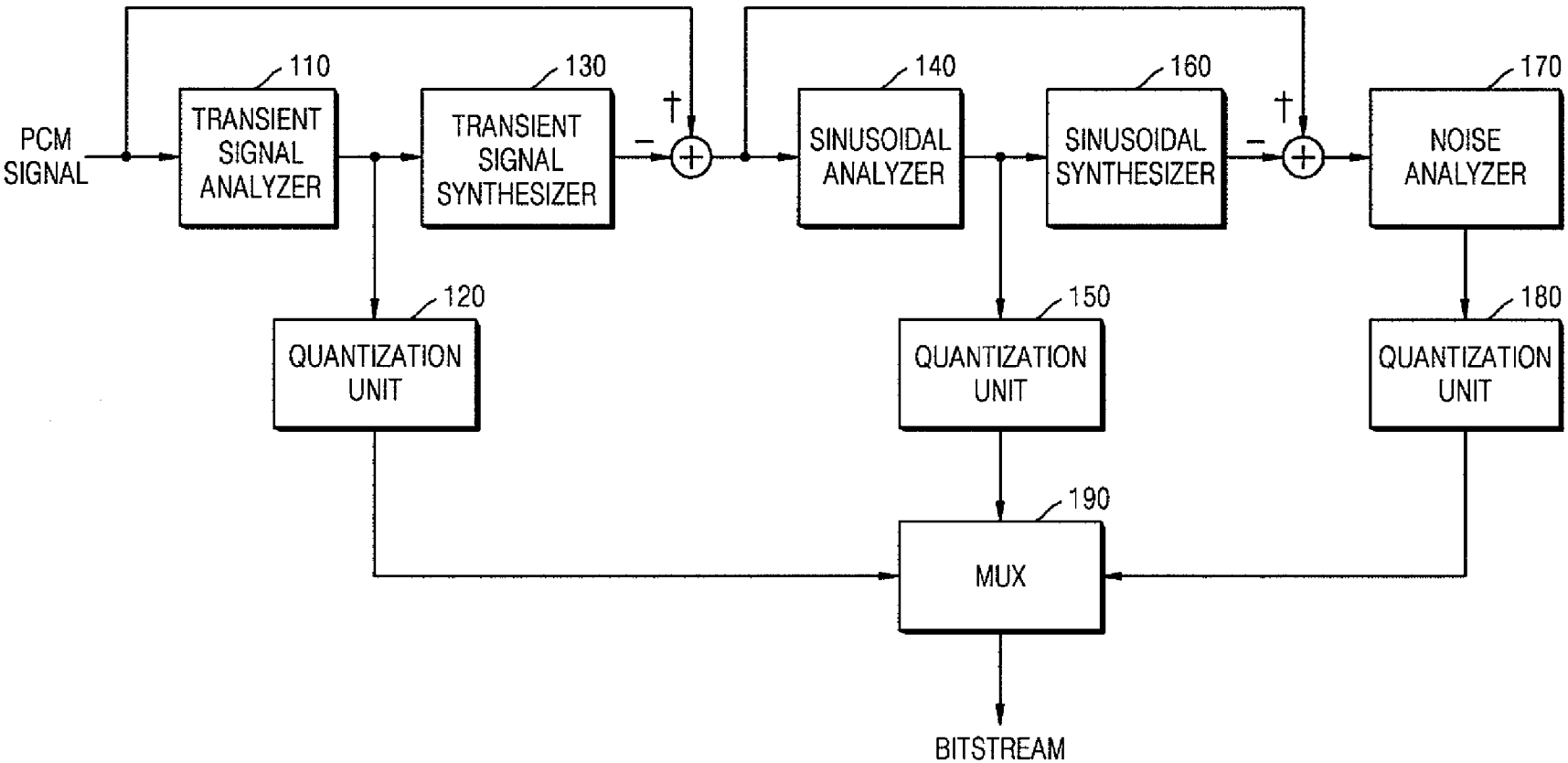
FIG. 1 (RELATED ART)
FIG. 1 is a simplified block diagram of a related art parametric encoding apparatus.
Figure 2:
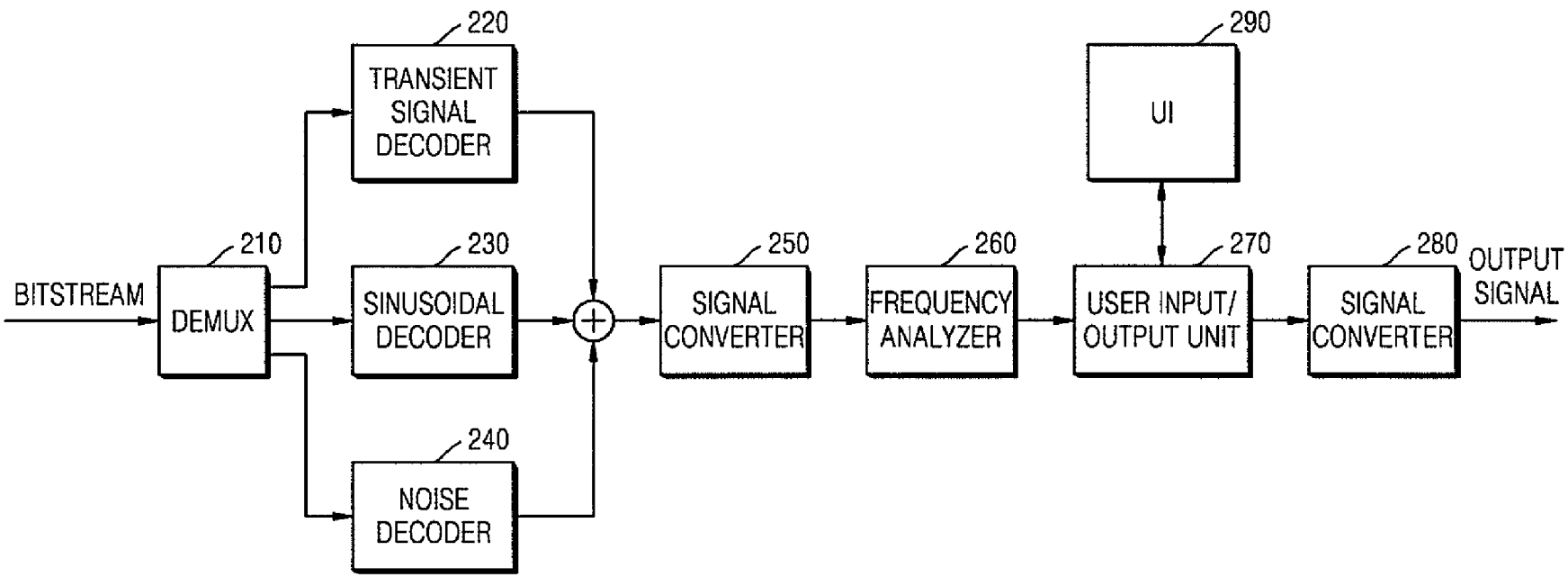
FIG. 2 (RELATED ART)
FIG. 2 is a simplified block diagram of a related art parametric decoding apparatus.
Figure 3:
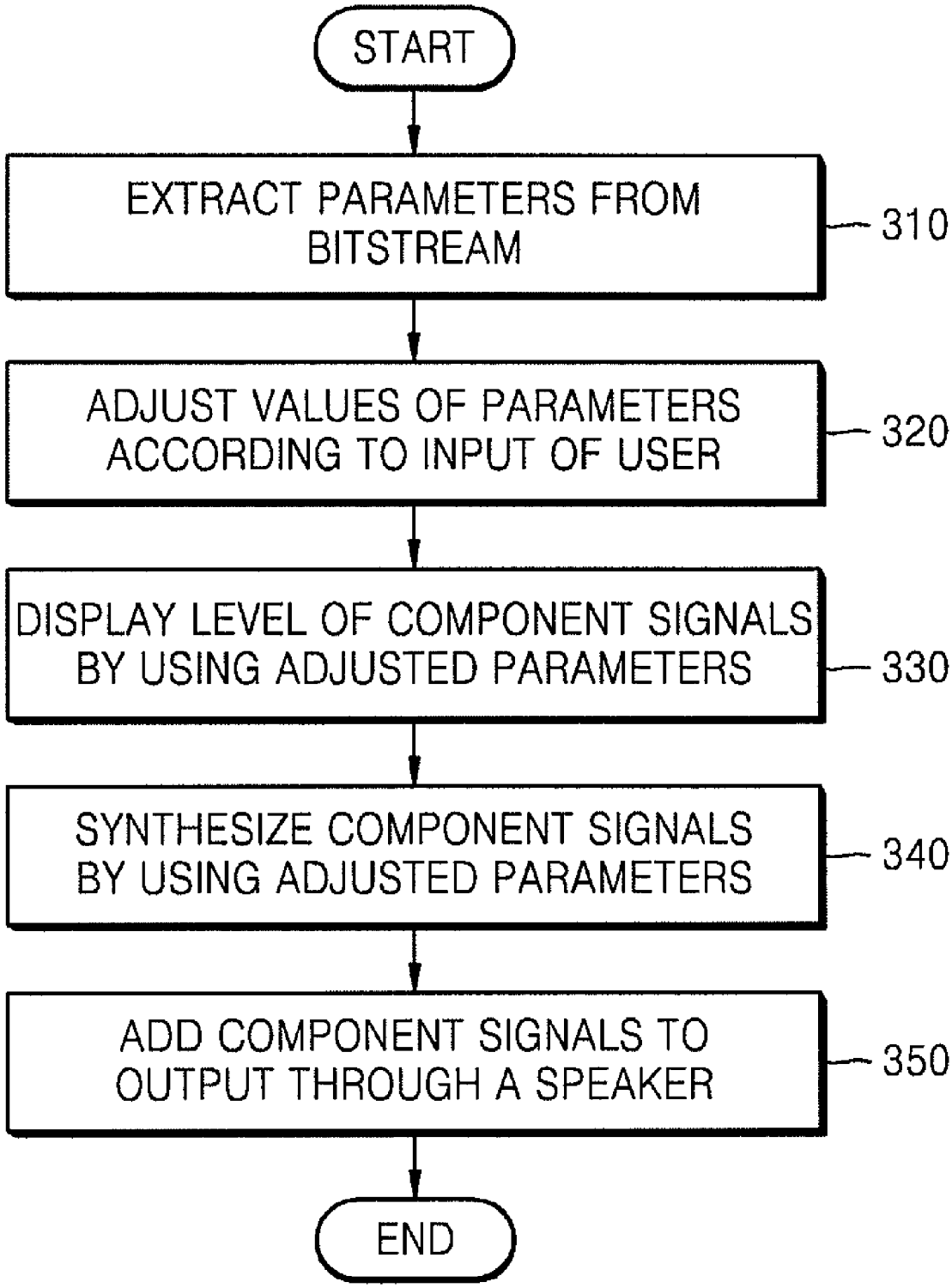
FIG. 3 is a flowchart illustrating a method of decoding an audio signal according to an exemplary embodiment of the present invention.

FIG. 3 is a flowchart illustrating a method of decoding an audio signal according to an exemplary embodiment of the present invention.

In operation 310, parameters with respect to component signals of an audio signal are extracted from an input bitstream. For example, the component signals may be transient signals, sinusoidal signals, and noise. Here, the transient signal is a component signal which changes characteristics of all signals at a point in a time domain or a frequency domain. The component signals of the audio signal are assumed according to a modeling method and this will be well known to one of ordinary skill in the art.

The parameters are characteristic values required to restore each of the component signals and various parameters can exist according to exemplary embodiments of the present invention. For example, the sinusoidal signals may be phase, amplitude, and frequency.

In operation 320, the values of the parameters indicating the characteristics of the component signals are adjusted according to an input by a user. In the case of the noise and the transient signal, a user can adjust the amplitudes of the component signals. In the case of the sinusoidal signals, the amplitude of the sinusoidal waves can be adjusted in each of the frequency bands.

In operation 330, levels of the component signals, that is, amplitudes of the component signals, are displayed to the user by using the parameters adjusted according to the input of the user. Here, a means for displaying is not particularly restricted. A displaying means for the sinusoidal signals may display the amplitudes of the sinusoidal signals in each frequency band.

In operation 340, each of the component signals of the audio signal is synthesized based on the parameters adjusted according to the input of the user.

In operation 350, the synthesized component signals are added together to be output through a speaker.

Unlike a related art conventional decoding apparatus, the audio signal decoding apparatus according to an exemplary embodiment of the present invention adjusts the parameters indicating the characteristics of the component signals based on an input of a user before the audio signal is synthesized, synthesizes an output signal from the adjusted parameters, and additionally displays the amplitudes of the component signals, instead of analyzing the synthesized signals from the parameters to input into an equalizer.

Figure 4:
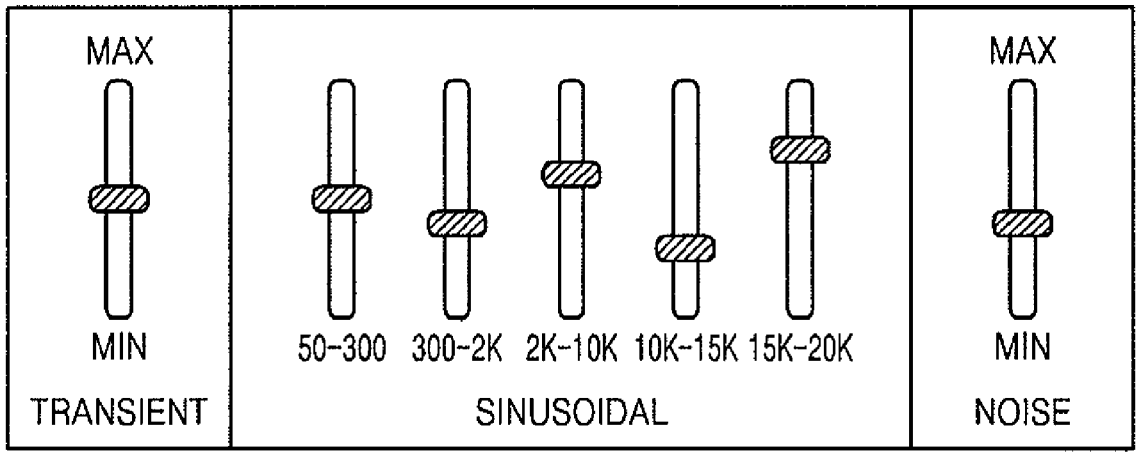
FIG. 4 is a diagram of a user interface included in an equalizer according to an exemplary embodiment of the present invention.

FIG. 4 is a diagram of a user interface included in an equalizer according to an exemplary embodiment of the present invention.

As illustrated in FIG. 4, the user interface of the equalizer includes sections for adjusting the amplitudes of the transient signals, the sinusoidal signals, and the noise.

Unlike the interfaces for the transient signals and the noise, the interface for the sinusoidal signals may be embodied to adjust the amplitudes of the sinusoidal signals in each of a plurality of frequency bands. In such an interface, for example, if a user adjusts an input lever of 300-2 k, the amplitudes of the sinusoidal signals having frequencies of 300 Hz to 2000 Hz are collectively changed. The user interface illustrated in FIG. 4 may be embodied by using hardware or software.

Figure 5:
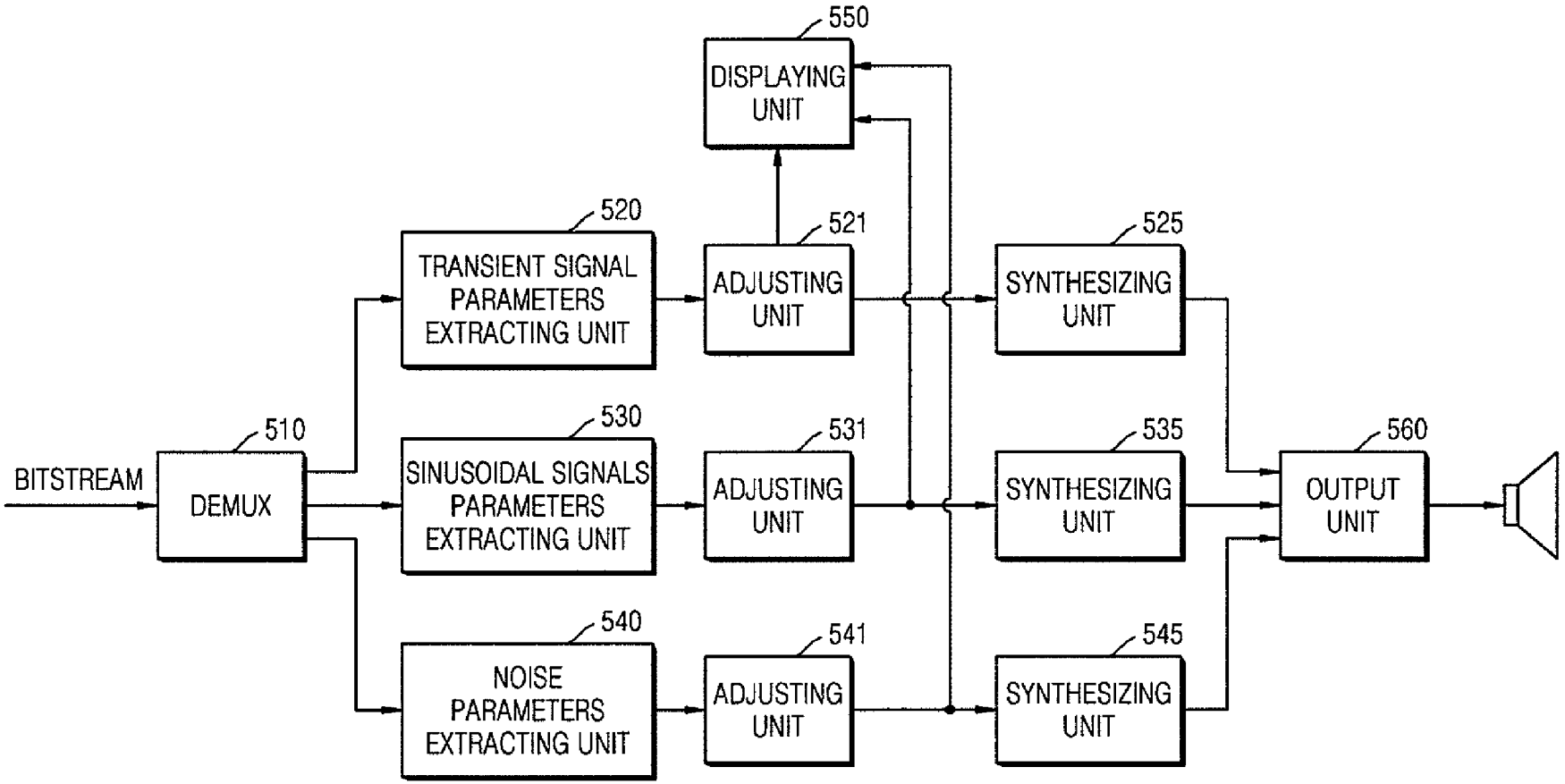
FIG. 5 is a block diagram of a parametric decoding apparatus according to an exemplary embodiment of the present invention.

FIG. 5 is a block diagram of a parametric decoding apparatus according to an exemplary embodiment of the present invention.

As illustrated in FIG. 5, the parametric decoding apparatus includes a demultiplexer 510, extracting units 520, 530, and 540, adjusting units 521, 531, and 541, synthesizing units 525, 535, and 545, a displaying unit 550, and an output unit 560.

The demultiplexer 510 provides a parametric encoded bitstream to the extracting units 520, 530, and 540.

The transient signal parameters extracting unit 520 extracts the transient signal parameters indicating the characteristics of the transient signal from the input bitstream. The adjusting unit 521 adjusts the extracted transient signal parameters according to an input of a user. The displaying unit 550 displays the amplitude of the transient signal which corresponds to the adjusted transient signal parameters.

The synthesizing unit 525 synthesizes the transient signals by using the adjusted transient signal parameters.

The sinusoidal signals parameters extracting unit 530 extracts the sinusoidal signals parameters indicating the characteristic of the sinusoidal signals from the input bitstream. The adjusting unit 531 adjusts the extracted sinusoidal signals parameters according to an input of a user. The displaying unit 550 displays the amplitude of the sinusoidal signals which corresponds to the adjusted transient signal parameters. In this case, the adjusting unit 531 and the displaying unit 550 may provide a user interface to a user to adjust/display the amplitudes of the sinusoidal signals in each frequency band.

The synthesizing unit 535 synthesizes the sinusoidal signals by using the adjusted transient signal parameters.

The noise parameters extracting unit 540 extracts the noise parameters indicating the characteristics of the noise from the input bitstream. The adjusting unit 541 adjusts the extracted noise parameters according to an input of a user. The displaying unit 550 displays the amplitude of the noise which corresponds to the adjusted noise parameters.

The synthesizing unit 545 synthesizes the noise by using the adjusted noise parameters.

The output unit 560 adds the component signals output from the synthesizing units 525, 535, and 545 together to generate an output signal and outputs the signal through a speaker.

According to the present invention, instead of converting a decoded audio signal to adjust frequency components or to display to a user, the parameters extracted during decoding are adjusted by a user and the component signals are synthesized and adjusted by using the adjusted parameters. Thus, a user can adjust the component signals by him/herself according to his/her desire so that various sound effects can be realized.

In addition, the original signal can be restored more accurately than that of the related art and additional equalizer modules are not required. Therefore, complexity of the audio reproduction apparatus can be reduced.

The exemplary embodiments of the present invention can be written as computer programs and can be implemented in general-use digital computers that execute the programs using a computer readable recording medium.

Examples of the computer readable recording medium include magnetic storage media (e.g., ROM, floppy disks, hard disks, etc.), and optical recording media (e.g., CD-ROMs, or DVDs).

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A decoding method comprising:

extracting parameters from a parametric encoded audio signal with respect to component signals of the parametric encoded audio signal;

adjusting the extracted parameters according to an input of a user; and synthesizing each of the component signals of the parametric encoded audio signal based on the adjusted parameters, wherein the component signals comprise transient signals, sinusoidal signals and noise.

2. The method of claim 1, further comprising:

displaying amplitudes of the component signals of the parametric encoded audio signal which correspond to the adjusted parameters through a user interface.

3. The method of claim 2, wherein in the displaying of the amplitudes, the amplitudes of the sinusoidal signals of each frequency band included in the parametric encoded audio signal are displayed.

4. The method of claim 1, wherein in the adjusting of the extracted parameters, amplitudes of the sinusoidal signals of each frequency band included in the parametric encoded audio signal are adjusted independently.

5. The method of claim 1, further comprising:

adding the synthesized component signals together to output the resultant signal through a speaker.

6. A computer readable recording medium having embodied thereon a computer program for executing a decoding method, the decoding method comprising:

extracting parameters from a parametric encoded audio signal with respect to component signals of the parametric encoded audio signal;

adjusting the extracted parameters according to an input of a user; and synthesizing each of the component signals of the parametric encoded audio signal based on the adjusted parameters, wherein the component signals comprise transient signals, sinusoidal signals and noise.

7. The computer readable recording medium according to claim 6, wherein the decoding method further comprises:

displaying amplitudes of the component signals of the parametric encoded audio signal which correspond to the adjusted parameters through a user interface.

8. The computer readable recording medium according to claim 7, wherein in the displaying of the amplitudes, the amplitudes of the sinusoidal signals of each frequency band included in the parametric encoded audio signal are displayed.

9. The computer readable recording medium according to claim 6, wherein in the adjusting of the extracted parameters, amplitudes of the sinusoidal signals of each frequency band included in the parametric encoded audio signal are adjusted independently.

10. The computer readable recording medium according to claim 6, wherein the decoding method further comprises:

adding the synthesized component signals together to output the resultant signal through a speaker.

11. An audio signal decoding apparatus comprising:

an extracting unit which extracts parameters from a parametric encoded audio signal with respect to component signals of the parametric encoded audio signal;

an adjusting unit which selectively adjusts the extracted parameters according to an input of a user; and a synthesizing unit which synthesizes each of the component signals of the parametric encoded audio signal based on the selectively adjusted parameters, wherein the component signals comprise transient signals, sinusoidal signals and noise.

12. The audio signal decoding apparatus of claim 11, further comprising:

a displaying unit which displays amplitudes of the component signals of the parametric encoded audio signal which correspond to the adjusted parameters through a user interface.

13. The audio signal decoding apparatus of claim 12, wherein the displaying unit displays the amplitudes of the sinusoidal signals of each frequency band included in the parametric encoded audio signal.

14. The audio signal decoding apparatus of claim 11, wherein the adjusting unit adjusts independently amplitudes of the sinusoidal signals of each frequency band included in the parametric encoded audio signal.

15. The audio signal decoding apparatus of claim 11, further comprising an output unit which adds the component signals synthesized by the synthesizing unit and outputs the resultant signal through a speaker.

* * * * *